United States Patent [19]

Ikeuchi

[11] 4,415,123

[45] Nov. 15, 1983

[54] ATOMIZER NOZZLE ASSEMBLY

[75] Inventor: Hiroshi Ikeuchi, Ashiya, Japan

[73] Assignee: H. Ikeuchi & Co., Ltd., Osaka, Japan

[21] Appl. No.: 281,047

[22] Filed: Jul. 7, 1981

[30] Foreign Application Priority Data

Aug. 22, 1980 [JP] Japan ..... 55-116215

[51] Int. Cl.[3] ..... B05B 7/06

[52] U.S. Cl. ..... 239/425; 239/426

[58] Field of Search ..... 239/418, 419.3, 422, 239/421, 424.5, 425, 428, 429, 432, 434, 543, 544, 427.3, 600, 426, 431

[56] References Cited

U.S. PATENT DOCUMENTS

| | | | |
|---|---|---|---|
| 1,070,872 | 8/1913 | Bond | 239/425 |
| 2,247,781 | 7/1941 | Leiman | 239/425 |
| 2,364,717 | 12/1944 | Huss | 239/543 |
| 2,935,128 | 5/1960 | Ferguson | 239/425 |
| 3,062,454 | 11/1962 | Cocks | 239/543 |
| 3,537,650 | 11/1970 | Peczeli et al. | 239/426 |
| 4,050,633 | 9/1977 | Courson | 239/600 |
| 4,284,239 | 8/1981 | Ikeuchi | 239/544 |

FOREIGN PATENT DOCUMENTS

| | | | |
|---|---|---|---|
| 1030190 | 5/1966 | United Kingdom | 239/419.3 |

*Primary Examiner*—Andres Kashnikow
*Assistant Examiner*—Michael J. Forman
*Attorney, Agent, or Firm*—Wenderoth, Lind & Ponack

[57] ABSTRACT

An atomizing nozzle comprises at least two nozzle heads arranged in particular relation to each other. Each of the nozzle heads has a discharge port through which a simple jet of liquid drops are jetted. These nozzle heads are so arranged that the respective longitudinal axes of these nozzle heads intersect at a predetermined angle with each other while each of the discharge ports is spaced a predetermined distance from the point of intersection of these longitudinal axes.

4 Claims, 10 Drawing Figures

ATOMIZER NOZZLE ASSEMBLY

BACKGROUND OF THE INVENTION

The present invention generally relates to an atomizer and, more particularly, to a nozzle assembly for the atomizer which is effective to produce drops of liquid of a size ranging from a submicron to tens of micron and which can be used in a number of applications, e.g., atomizing water, oil, medical solution or the like liquid.

Of various types of atomizers, an ultrasonic atomizer is well known as an instrument for producing very fine drops of liquid at a rate required enough to make the atomizer available for industrial purpose. However, the prior art ultrasonic atomizer requires a relatively large amount of compressed air to operate and, therefore, a compressor of a relatively large size, which is generally expensive, must be prepared therefor.

In addition, the atomizing nozzle head used in the prior art ultrasonic atomizer essentially requires the employment of a resonant cavity which is generally fragile and susceptible to damage. Because of this, the applicability of the ultrasonic atomizer now available is limited.

As is well known to those skilled in the art, an atomizing technique is utilized in various fields of industry for a particular purpose. For example, metallurgical and ceramic industries utilizes the atomizer to produce a mist of liquid volant for forced-cooling of heated products (e.g., metal and glass plates); medical establishments and food processing industries utilize the atomizer to produce a mist of liquid disinfectant for keeping rooms in sanitary condition; and farmers utilize the atomizer to spray a liquid insecticide or insectifuge over farms within or outside hothouses or vinyl houses, although they are not limited thereto. Moreover, the atomizer is also utilized for spraying, sprinkling or misting any of various kinds of liquid mediums other than those mentioned above, for example, deodorant, water for humidifying, heavy oil, gasoline, lubricant and so on.

As a result of a series of experiments conducted to find the nature and characteristics of atomized liquid utilizable for such various purposes as mentioned above, it has been found that the atomization must satisfy the following requirements.

(a) Drops produced must have a maximum particle size within the range of 50 to 100 microns.

(b) Drops produced are preferred to be distributed as uniformly as possible and over an area or space as small as possible.

(c) Machines and equipments required to produce atomized liquid must be simple in construction, inexpensive and of a type that does not result in the increased maintenance cost.

The Japanese patent application No. 53-122155 filed in 1978, the invention of which has been assigned to the assignee of the present invention discloses the atomizer effective to satisfy the above mentioned requirements.

BRIEF SUMMARY OF THE INVENTION

The present invention is an improvement of the atomizer disclosed in the above mentioned Japanese application and has for its essential object to provide an improved atomizer effective to produce a mist of very fine drops of not more than 10 microns in particle size.

According to the present invention, an improved atomizer nozzle assembly comprises at least two nozzle heads of identical construction which are arranged in a particular relation to each other. Each of the nozzle heads of identical construction comprises a generally elongated hollow body having one end opening and the other end having a constricted discharge port defined therein in coaxial relation to the longitudinal axis of the hollow in the body, said body also having first and second supply ports communicated to the hollow in the body on the one hand and adapted to be fluid-connected to respective sources of compressible and incompressible fluids on the other hand. An elongated nozzle tip member having first and second passage means defined therein is housed within the hollow in the body in coaxial relation thereto and has one end outwardly tapered and positioned adjacent the discharge port. The open end of the body opposite to the discharge port is closed by a plug member. The plug member so mounted on the body to close the open end thereof is held in contact with the other end of the tip member to hold the latter in position steadily within the hollow. In this construction, the first passage means communicates the first supply port to the discharge port whereas the second passage means communicates the second supply port to the discharge port.

In accordance with the present invention, the nozzle heads each being of the construction described above are so supported that the longitudinal axes of said respective nozzle heads can intersect with each other at an angle within the range of 70° to 160° C. and that the discharge port of each of the nozzle heads is spaced a distance within the range of 3 to 15 mm from the imaginary point of intersection between the respective longitudinal axes of the nozzle heads. In addition, where the number of the nozzle heads employed is two they should be positioned in opposed relation to each other, one on each side of the imaginary point of intersection. However, if the number of the nozzle heads is more than two, they should be positioned in equally spaced relation to each other and also to the imaginary point of intersection of the respective longitudinal axes of the nozzle heads.

By constructing the nozzle assembly in the manner as hereinabove described, a simple jet of fluid drops emerging from one of the discharge ports in the associated nozzle heads can impinge on a simple jet of fluid drops emerging from the other of the discharge port at the imaginary point of intersection of the respective longitudinal axis of the nozzle heads, thereby producing a mist of very fine drops of fluid of not more than 10 microns in particle size travelling as far as possible, for example, 3 meters or more away from the assembly. The simple jet of drops from the discharge port in each of the nozzle heads can be formed either by supplying an incompressible fluid, that is, liquid, under pressure or by causing a compressible fluid, that is, a compressed air, to draw the imcompressible fluid to reduce the latter to a spray.

BRIEF DESCRIPTION OF THE DRAWINGS

These and other objects and features of the present invention will become apparent from the following description taken in conjunction with preferred embodiments thereof with reference to the accompanying drawings, in which.

Before the description of the present invention proceeds, it is to be noted that like parts are designated by like reference numerals throughout the accompanying drawings.

DETAILED DESCRIPTION OF THE PREFERRED EMBODIMENTS

Figure 1:
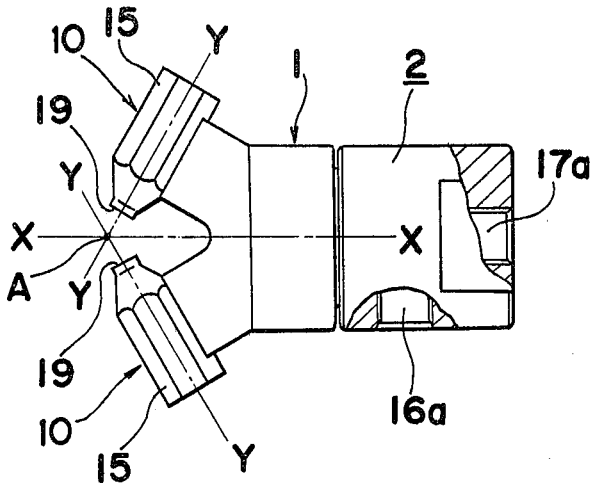
FIG. 1 is a side elevational view, with a portion broken away, of a nozzle assembly embodying the present invention.
Figure 2:
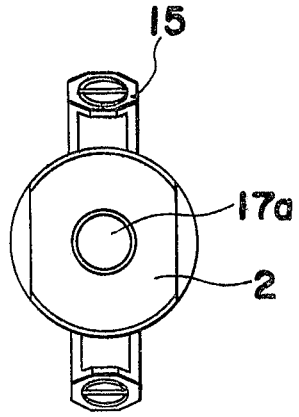
FIG. 2 is a rear elevational view of the nozzle assembly as viewed from right in FIG. 1.
Figure 3:
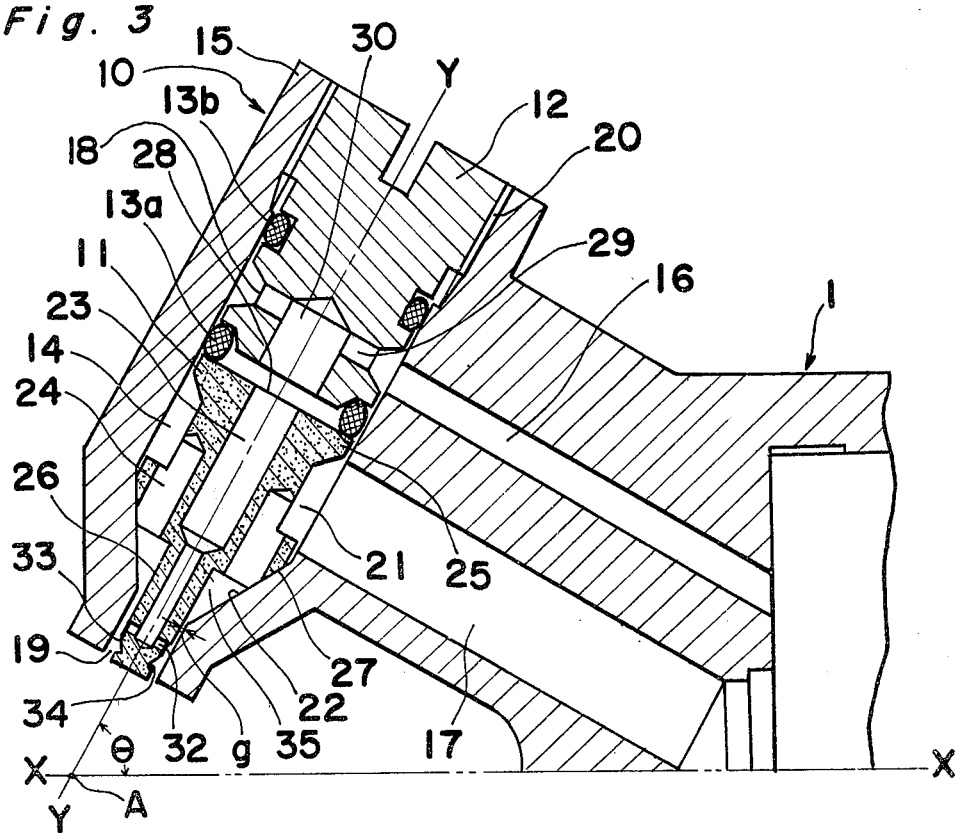
FIG. 3 is a side sectional view, on an enlarged scale, of one of two identical nozzle heads used in the nozzle assembly according to a first preferred embodiment of the present invention.

Referring first to FIGS. 1 and 2, a nozzle assembly for an atomizer comprises a support barrel 1 of generally Y-shaped configuration having one end threaded, or otherwise connected, to a fluid coupler 2 and also having a pair of arms protruding therefrom in a direction remote from the coupler 2 so as to diverge outwardly from each other, said arms carrying respective nozzle heads, generally identified by the numeral 10, of identical construction as best shown in FIG. 3.

Each of said arms of the support barrel 1 has liquid and air passages 16 and 17 defined therein. The liquid and air passage 16 in the respective arms are fluid-connected to liquid and air supply passage 16*a* and 17*a* defined in the coupler 2 which are adapted to be coupled to respective sources of liquid and compressed air.

Since the nozzle heads 10 are of identical construction with each other, only one of them will now be described in detail with particular reference to FIG. 3 for the sake of brevity. Referring now to FIG. 3, the nozzle head 10 comprises a generally cylindrical body or casing 15 integral with the corresponding arm of the support barrel 1 and having an axially extending hollow 14 defined therein. The cylindrical body 15 has one end opened and internally threaded at 20 and the opposite end formed with a discharge port 19 in coaxial relation to the longitudinal axis of the hollow 14, said internally threaded open end of the cylindrical body 15 being closed by an externally threaded plug member 12. For the purpose as will be described later, a portion of the interior wall of the cylindrical body 15 adjacent the discharge port 19 is tapered at 22 towards the discharge port 19 to define a generally frusto-conical cavity 35 forming a part of the hollow and continued to a cylindrical hollow portion adjacent the plug member 12 and on one side of the frusto-conical cavity 35 opposite to the discharge port 19. The nozzle head 10 is so carried by and so fixed relative to the support barrel 1 that the longitudinal axis Y—Y of the hollow 14 passing through the center of the discharge port 19 can intersect the longitudinal axis X—X of the support barrel 1 at an angle $\theta$ within the range of 35° to 80° and that the tip of the cylindrical body 15 adjacent the discharge port 19 can be spaced a predetermined distance of 3 to 15 mm, preferably 4.75 to 10.9 mm, from the imaginary point A of intersection of the respective longitudinal axes X—X and Y—Y of the barrel 1 and hollow 14.

The externally threaded plug member 12 closing the open end of the cylindrical body 15 opposite to the discharge port 19 is of a configuration having a circumferentially extending annular groove 18 defined therein and communicated to the hollow 14 through one or more radial passages 29 and then through a blind hole 30, said blind hole 30 being defined in the plug member 12 and opening towards the hollow 14.

The nozzle head 10 also comprises a nozzle tip member 11 having an axial passage 23 defined therein in coaxial relation to the longitudinal axis thereof. This nozzle tip member 11 is constituted by a large diameter portion 25 of an outer diameter substantially equal to the diameter of the cylindrical hollow portion of the hollow 14 and a reduced diameter portion 26 of an outer diameter slightly smaller than the discharge port 19. An outer peripheral edge area of the large diameter portion 25 adjacent the reduced diameter portion 26 is bevelled or chamferred at 27 to conform to the tapered interior wall portion 22 of the cylindrical body 15 such that, when the tip member 11 is housed within the hollow 14 of the cylindrical body 15 with the internal annular end of the plug member 12 held in contact with the annular end 28 of the tip member 11 through an elastic seal ring 13*a*, the free end of the reduced diameter portion 26 is positioned inside the discharge port 19 while the chamferred peripheral edge area 27 contacts and seated against the tapered interior wall portion 22. The axial passage 23 defined in the tip member 11 is communicated to the circumferentially extending groove 18 on the plug member 12 through the blind hole 30 and the radial passages 29 both in the plug member 12. This axial passage 23 extends axially in the tip member 11 from one end of the large diameter portion 25 adjacent the plug member 12 and terminates at a position inwardly of the free end of the reduced diameter portion 26 where one or more liquid discharge passages 32 are radially defined, said axial passage 23 being so communicated to the discharge port 19 that the liquid supplied into the axial passage 23 is a manner as will be described later can be drawn through the liquid discharge passages 32 and then through the discharge port 19 to the outside thereby forming a simple jet of fine liquid drops as a compressed air flows at a high velocity towards the outside through a clearance g between the discharge port 19 and the free end portion of the reduced diameter portion 26.

The tip member 11 also has an annular recess 21, defined circumferentially on the large diameter portion 25, and a plurality of connecting passages 24 defined in the large diameter portion 25 in parallel relation to each other in a direction axially of the tip member 11, said annular recess 21 being communicated to the frustoconical cavity 35 through the connecting passages 24. These passages 24 allow the compressed air supplied to the annular recess 21 through the air passage 17 to flow therethrough towards the discharge port 19 by way of the frusto-conical cavity 35.

At the free end of the reduced diameter portion 26 of the tip member 11, the tip member is gradually reduced in diameter at 33 to define an outwardly converging annular wall and then enlarged at 34 to define a collision area, for the purpose which will become clear from subsequent description.

It is to be noted that reference numeral 13*a* represents an elastic seal ring mounted on the plug member 12 at a position on one side of the annular groove 18 opposite to the seal ring 13*a*, the function of each of the seal rings 13*a* and 13*b* being well known to those skilled in the art. It is also to be noted that, where the tip member 11 is made of ceramics instead of metal or hard synthetic resin, the seal ring 13*a* serves in addition to the prevention of leakage of the fluid medium from the annular groove 18 into the annular recess 21, and vice versa, to impart a cushioning effect to the tip member 11 to minimize or substantially eliminate any possible breakage of such tip member 11.

Referring still to FIG. 3, the nozzle head 10 is so designed and so constructed as to operate in the following manner. Assuming that a compressor is operated to supply compressed air into the annular recess 21 through the air passage 17, the compressed air in the annular recess 21 flows towards the outside of the nozzle head 10 through the connecting passages 24, then the frusto-conical cavity 35 and finally the clearance g between the free end of the reduced diameter portion 26 and the cylindrical wall defining the discharge port 19. As the compressed air flows at high velocity past the external openings of the liquid discharge passages 32 facing the clearance g, the liquid inside the axial passage 23 which is then communicated to a source of the liquid, for example, a liquid reservoir, through the blind hole 30, then the annular groove 18 and finally the liquid passage 16, is drawn under the influence of a negative force into the clearance g and is then discharged to the outside of the nozzle head through the discharge port 19 together with the compressed air, thereby forming a simple jet of the liquid drops travelling generally in alignment with the longitudinal axis Y—Y. At this time, the pressure of the compressed air is increased as it enters the frusto-conical cavity 35 through the connecting passages 24. The outwardly converging annular wall 33 on the free end of the reduced diameter portion 26 of the nozzle tip member 11 serves to effect a sudden drop of the pressure of a fluid mixture of the compressed air with the liquid so that the fluid mixture can be agitated upon subsequent collision against the collision area 34 prior to being discharged to the outside through the discharge port 19. Accordingly, it is clear that the liquid once atomized as the compressed air flows past the openings of the liquid discharge passages 32 is further finely divided as a result of the turbulent flow occurring at the grooved region defined by the outwardly converging annular wall 33 and the collision area 34, thereby forming a mist or spray of fine liquid drops as it emerges outwards from the discharge port 19.

The nozzle heads 10 each being of the construction as hereinbefore described with particular reference to FIG. 3 are carried by the support barrel 1 in opposed relation to each other such that respective simple jets of fine liquid drops discharged from the discharge ports 19 impinge upon each other at the imaginary point A of all of the longitudinal axes X—X and Y—Y as shown in FIGS. 1 and 3, thereby producing a mist of very fine liquid drops.

Figure 4:
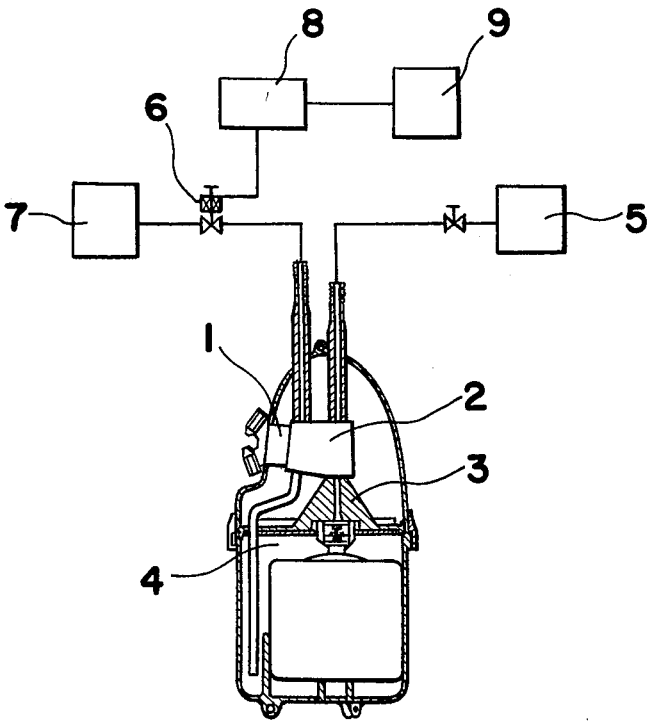
FIG. 4 is a longitudinal sectional view of an atomizer system employing the nozzle assembly according to the present invention.

In FIG. 4, the nozzle assembly embodying the present invention is shown as used in an atomizer system for humidification for industrial use. This atomizer system is shown as comprising a support 3 for the support of the nozzle assembly through the adaptor 2, and a liquid reservoir 4 to which the liquid supply passage 16*a* in the adaptor 2 is fluid-connected. The liquid reservoir 4 is in turn communicated to a source 5 of liquid while the air supply passage 17*a* in the adaptor 2 is communicated to a source 7 of compressed air through an electromagnetic control valve 6. The control valve 6 is adapted to be controlled by an electric controller 8 operable in response to the presence and absence of an output signal from a humidity sensor 9 in such a manner that, when the humidity in the room where the sensor 9 is installed increases over or decreases below a predetermined value, the control valve 6 is opened or closed, respectively.

Shown in FIG. 4 is merely one of numerous examples of application of the nozzle assembly according to the present invention, which are obvious to those skilled in the art.

In the construction as hereinbefore fully described, so far as each of the nozzle heads 10 is involved, the amount and the particle size of the liquid drops jetted from the discharge port 19 are affected by, and very depending on, the position, bore size and/or number of the liquid discharge passages 32, the size of the clearance g between the discharge port 19 and the free end portion of the reduced diameter portion 26 of the tip member 11, and/or the angle of convergence of the outwardly converging annular wall 33.

However, in the case where the nozzle assembly comprises a plurality of identical nozzle heads 10 and is so designed as to produce a mist of very fine liquid drops by causing a corresponding number of simple jets or liquid drops, produced by the individual nozzle heads 10, to impinge upon the imaginary point A of intersection of all of the longitudinal axes X—X and Y—Y, the position of one nozzle head 10 relative to the other nozzle heads with respect to the longitudinal axis X—X, the angle $\theta$ of inclination of each of the nozzle heads 10 relative to the longitudinal axis X—X and/or the distance between the imaginary point A of intersection and the discharge port 19 of each nozzle head 10 are determined in consideration of the amount and/or the particle size of the liquid drops jetted from any one of the nozzle heads 10. By way of example, where a large amount of a mist of very fine liquid drops of an average particle size as small as possible is desired to be produced by the use of the above described system operated with a liquid supplied under a pressure of 0 $Kg/cm^2$ and a compressed air supplied at a rate as small as possible under a pressure as small as possible, for example, at a rate of 53 l/min under a pressure of 2.0 $Kg/cm^2$, a series of experiments have shown that each of the neighboring nozzle heads are preferred to be angularly spaced a maximum possible distance from each other with respect to the longitudinal axis X—X, for example, 180° where the number of the nozzle heads is two; that the angle $\theta$ of inclination of each of the nozzle heads relative to the longitudinal axis X—X is preferably within the range of 35° to 80° and, in other words, the angle formed between the longitudinal axes of the two nozzle heads is preferably within the range of 90° to 150°; and that the distance b between the discharge port of each of the nozzle heads and the imaginary point A of intersection is preferably within the range of 3 to 15 mm and, more preferably within the range of 4.75 to 10.9 mm.

Where the angle formed between the respective longitudinal axes of the two nozzle heads is smaller than 70°, a force of impingement of the respective simple jets of liquid drops produced from there two nozzle heads is so very weak as to lower the mist producing capacity of the nozzle assembly to such an extent that it no longer makes any difference between the nozzle assembly wherein the impingement of the simple jets of liquid drops is utilized and that wherein it is not utilized. On the other hand, where the angle formed between the respective longitudinal axes of the two nozzle heads is larger than 160°, the force of impingement of the respective simple jets of liquid drops tends to become so excessively large as to result in the rebound of some of the liquid drops forming the simple jets, then impinging upon one another, towards the nozzle heads. Once this happens, the casings 15 for the nozzle heads are wetted to such an extent that liquid droplets wetting the casings will subsequently gather together to form large particles of liquid falling from the casings of the nozzle heads.

As regards the distance between the discharge port of each nozzle head and the imaginary point A of intersection, if it is larger than 15 mm, a similar description to that made in connection with the case where the angle between the respective longitudinal axes of the nozzle heads is smaller than 70° can be applicable. On the other hand, if it is smaller than 3 mm, a similar description to that made in connection with the case where the angles between the longitudinal axes of the nozzle heads is larger than 160° can be applicable.

With respect to the number and the angular spacing of the nozzle heads, the employment of the two nozzle heads angularly spaced 180° from each other relative to the longitudinal axis X—X is preferred because of a relatively large force of impingement available and because of the minimized, or substantially eliminated, posibility of rebound of some liquid drops towards the nozzle heads. If the number of the nozzle heads is six and they are angularly spaced at intervals of 60° with respect to the longitudinal axis X—X, the force of impingement of the simple jets of liquid drops will be reduced.

Figure 5:
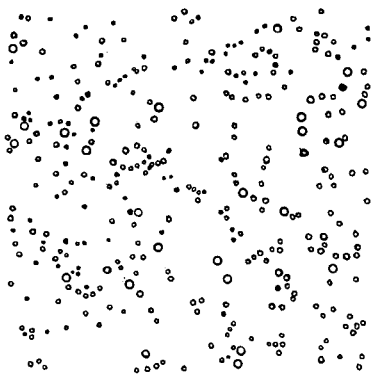
FIG. 5 is a diagram, reproduced from a photographic picture, on ×50 magnification, illustrating the pattern of distribution of liquid drops produced by both of the nozzle heads of the nozzle assembly of the present invention.
Figure 6:
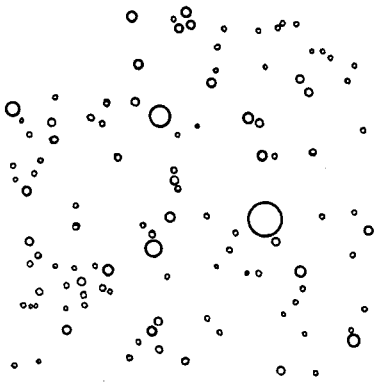
FIG. 6 is a diagram similar to FIG. 5, illustrating that produced from one of the identical nozzle heads of the nozzle assembly of the present invention.
Figure 7:
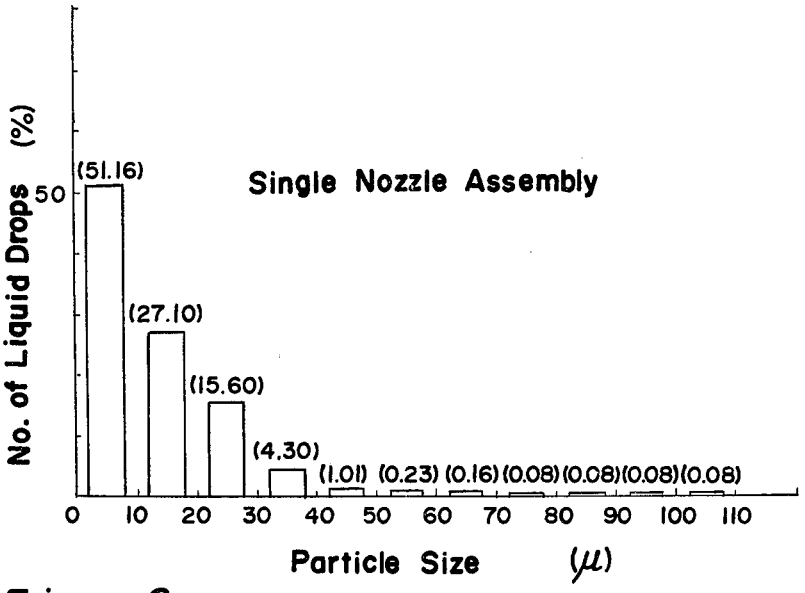
FIG. 7 is a statistic graph showing the number, in terms of percentage, of liquid drops for each particular particle size, which liquid drops are produced from one of the nozzle heads of the nozzle assembly of the present invention, FIG. 7 being corelated with FIG. 6.
Figure 8:
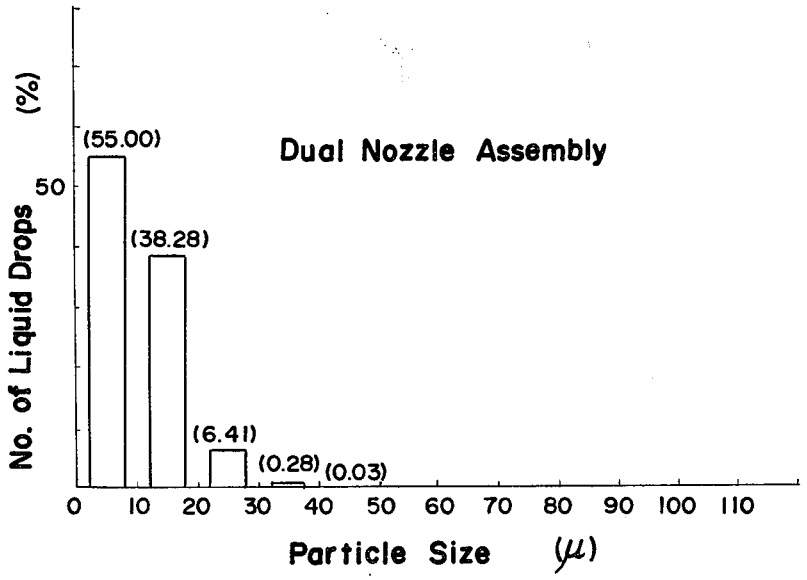
FIG. 8 is a statistic graph similar to FIG. 7, showing that produced from both of the nozzle heads of the nozzle assembly of the present invention, FIG. 8 being corelated with FIG. 5, and FIGS. 9 and 10 are respective side sectional views similar to FIG. 3, showing the nozzle assembly according to second and third preferred embodiments of the present invention.

Specifically, when a system similar to that shown in FIG. 3, but wherein the nozzle assembly included the only nozzle head was operated with the supply of liquid under pressure of 0 $Kg/cm^2$ from the liquid source 7 and the supply of compressed air under pressure of 30 $Kg/cm^2$ from the compressed air source 5 so as to produce fine liquid drops at a rate of 6 l/hr., it has been found that the average and maximum particle sizes of the liquid drops jetted forwards a panel spaced one meter from the nozzle head were 35.1$\mu$ and 110$\mu$, respectively, with the particle sizes distributed as shown in the graph of FIG. 7, the pattern of distribution of the liquid drops on the panel being shown in a reproduced drawing of FIG. 6 taken from a photograph of the panel at ×50 magnification. However, when the system shown in FIG. 3 wherein the two nozzle heads were angularly spaced 180° from each other with their longitudinal axes converging at 120° at the imaginary point A of intersection and with their discharge ports spaced 4.75 mm from the imaginary point A of intersection was operated with the supply of liquid and compressed air under the same respective pressures so as to produce a mist of liquid drops at the same rate, it has been found that the average and maximum particle sizes of the liquid drops jetted towards a panel spaced the same distance from the nozzle assembly were 17.4$\mu$ and 45$\mu$, respectively, with the particle sizes distributed as shown in the graph of FIG. 8, the pattern of distribution of the liquid drops on the panel being shown in a reproduced drawing in FIG. 5 taken from a photograph of the panel at the same magnification.

From the foregoing, it is clear that, when the simple jets of liquid drops from the two nozzle heads are caused to impinge upon each other, a mist of very fine liquid drops of particle size smaller than that produced from the only nozzle head can be obtained with their uniform distribution.

Figure 9:
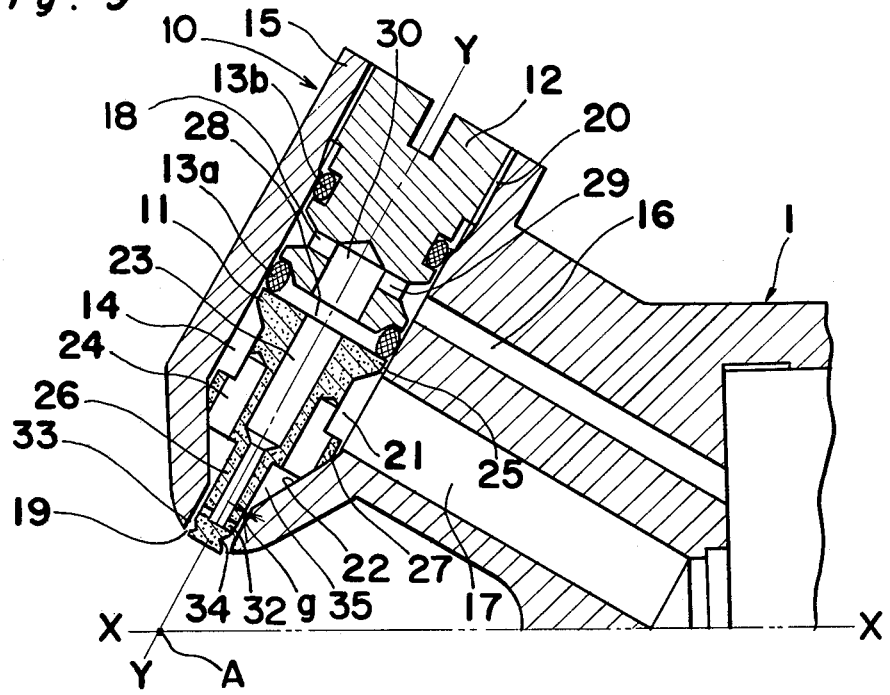

It is to be noted that a portion of the casing 15 of each nozzle head 10 adjacent the discharge port 19 is preferably tapered in a direction outwardly of the discharge port 19 is a manner as shown in FIG. 9 to avoid any possible adverse influence on the simple jet of liquid drops emerging from the discharge port 19, i.e., to avoid any possible formation of bulges of liquid adhering to that portion of the casing 15.

Figure 10:
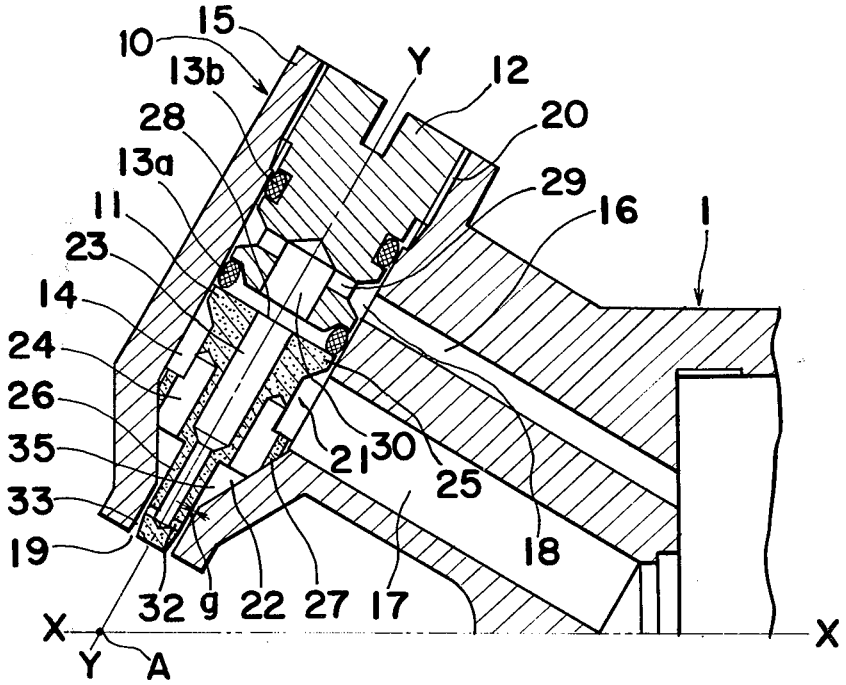

In addition, as shown in FIG. 10, the tip of the reduced diameter portion 26 of the tip member 11 on one side of the liquid discharge passages 32 remote from the large diameter portion 25 may be of a cylindrical or frustoconical configuration with no provision of the collision area such as defined by the annular walls 33 and 34 in the embodiment of any one of FIGS. 3 and 9, so that any possible formation of bulges of liquid, which would take place adjacent the collision area, can be avoided. As is also shown in FIG. 10, the tip of portion 26, including its end surface, is substantially within discharge port 19. In particular, the arrangement shown in FIG. 10 is advantageous where the liquid to be sprayed or atomized is supplied under a relatively high pressure.

It is to be noted that, in any one of the embodiments shown respectively in FIGS. 3, 9 and 10, the use of a ceramics as a material for the tip member 11 is advantageous in that a relatively high wear resistance can be appreciated with the life of each nozzle head prolonged accordingly. Moreover, the provision of the tapered interior wall 22 and the correspondingly bevelled or chamferred outer peripheral edge area 27 is advantageous in that the centering of the tip member 11 relative to the hollow 14 of the casing 15 can readily be achieved by only screwing in the plug member 12 after the tip member 11 has been inserted into the hollow 14.

Although the present invention has fully been described in connection with the preferred embodiments thereof with reference to the accompanying drawings, it is to be noted that various changes and modifications are apparent to those skilled in the art. Such changes and modifications are to be understood as included within the scope of the invention unless they depart therefrom.

What is claimed is:

1. An atomizing nozzle assembly comprising at least one pair of nozzle heads of identical construction, each of said nozzle heads comprising a generally elongated body having a longitudinal axis and having an interior space cylindrically symmetrical with respect to said longitudinal axis, said body having an end opening and a constricted discharge port at opposite ends of said body opening to said space in coaxial relation to said longitudinal axis, said body also having first and second supply ports communicated to said space on the one hand and adapted to be fluid-connected to respective sources of compressible and incompressible fluids on the other hand; an externally cylindrically symmetrical elongated nozzle tip member having first and second passage means defined therein and housed within said space in coaxial relation thereto, said tip member having opposite end portions respectively reduced and enlarged in diameter with the reduced diameter end portion situated adjacent said discharge port; and a plug member closing said end opening and held in contact with the enlarged diameter end portion of said tip member to hold said tip member in position steadily within said space, said first passage means communicating said first supply port to said discharge port and said second passage means communicating said second supply port to said discharge port, the nozzle heads of said at least one pair of nozzle heads being so supported relative to each other that the respective longitudinal axes of said nozzle heads can intersect with each other at an angle within the range of 70° to 160° with said discharge port of each of said nozzle heads facing towards the point of intersection of the respective longitudinal axes of said nozzle heads and spaced from said point of intersection a distance within the range of 3 to 15 mm;

said second passage means including a radially extending discharge passage opening from said reduced diameter end portion of said tip member into said discharge port, said reduced diameter end portion including a tip having a free end surface crossing said longitudinal axis substantially within said discharge port and a surface surrounding said longitudinal axis extending from the opening of said discharge passage to said free end surface, said surrounding surface having a circular cross-section perpendicular said longitudinal axis of non-increasing diameter along said longitudinal axis from said opening of said discharge passage to said free end surface, said surrounding surface including a frusto-conical surface terminating at said free end surface, whereby incompressible fluid flow through said discharge passage into said discharge port does not form bulges of incompressible fluid on said surrounding surface.

2. A nozzle assembly as claimed in claim 1, wherein a portion of the wall defining the hollow of the body adjacent the discharge port is tapered towards the discharge port and wherein an annular edge portion of the tip member at the boundary between the large and reduced diameter end portions is also tapered to conform to the tapered portion of the wall defining the hollow in the body.

3. A nozzle assembly as claimed in claim 1 or 2, wherein said at least two nozzle heads are angularly spaced 180° with respect to the point of intersection.

4. A nozzle assembly as in claim 1, wherein said surrounding surface is entirely frusto-conical.

* * * * *